US012054904B2

(12) United States Patent
Molyneux

(10) Patent No.: US 12,054,904 B2
(45) Date of Patent: Aug. 6, 2024

(54) TRENCH SHORING APPARATUS

(71) Applicant: SECURE GROUND SOLUTIONS LTD, Chester (GB)

(72) Inventor: Glenn Molyneux, Neston (GB)

(73) Assignee: SECURITY GROUND SOLUTIONS LTD., Chester (GB)

( * ) Notice: Subject to any disclaimer, the term of this patent is extended or adjusted under 35 U.S.C. 154(b) by 173 days.

(21) Appl. No.: 17/625,757

(22) PCT Filed: Jul. 1, 2020

(86) PCT No.: PCT/GB2020/051579

§ 371 (c)(1),
(2) Date: Jan. 9, 2022

(87) PCT Pub. No.: WO2021/009479

PCT Pub. Date: Jan. 21, 2021

(65) Prior Publication Data

US 2022/0275595 A1 Sep. 1, 2022

(30) Foreign Application Priority Data

Jul. 12, 2019 (GB) ..... 1910006

(51) Int. Cl.
*E02D 17/08* (2006.01)
*E02D 17/12* (2006.01)

(52) U.S. Cl.
CPC ..... *E02D 17/083* (2013.01); *E02D 17/12* (2013.01)

(58) Field of Classification Search
CPC ..... E02D 17/08; E02D 17/083
USPC ..... 405/282
See application file for complete search history.

(56) References Cited

U.S. PATENT DOCUMENTS 2,482,367 A * 9/1949 Ravers, Jr. ..... E02D 17/086 405/282
3,186,177 A * 6/1965 Kannenberg ..... E21D 19/00 405/282
3,263,430 A * 8/1966 Bryan ..... E02D 17/083 405/282
3,727,413 A * 4/1973 Christen ..... E02D 17/08 405/282
3,766,740 A * 10/1973 Teegen ..... E02D 17/08 405/282

(Continued)

FOREIGN PATENT DOCUMENTS

AU 2019393145 A1 * 7/2021 ..... E02D 17/08
CN 205839770 U 12/2016

(Continued)

*Primary Examiner* — Frederick L Lagman
(74) *Attorney, Agent, or Firm* — Craft Chu PLLC; Andrew W. Chu

(57) ABSTRACT

The trench shoring apparatus includes first and second side panels connected in a parallel spaced-apart configuration by a connecting bar pivotally connected to one end of one or more pairs of lateral arms. The other opposite end of the one or more pairs of lateral arms are hingedly connected to the side panels, such that translational movement of the connecting bar in a direction parallel to the side panels causes the spaced-apart panels to move between retracted and extended parallel spaced-apart configurations. There is a lock for releasably restricting translational movement of the connecting bar.

20 Claims, 11 Drawing Sheets

(56) References Cited

U.S. PATENT DOCUMENTS

| | | | | | |
|---|---|---|---|---|---|
| 4,202,649 | A * | 5/1980 | Cook | E02D 17/08 | 405/282 |
| 4,247,222 | A | 1/1981 | Schosek | | |
| 5,096,334 | A * | 3/1992 | Plank | E02D 17/08 | 405/282 |
| 5,232,313 | A * | 8/1993 | Jennings | E02D 17/083 | 405/282 |
| 7,101,119 | B2 * | 9/2006 | Cerda | E02D 17/08 | 405/282 |
| 7,258,511 | B1 * | 8/2007 | Cerda | E02D 17/08 | 405/282 |
| 7,530,767 | B2 * | 5/2009 | Davidson, Sr. | E02D 17/083 | 405/282 |
| 2009/0103986 | A1 * | 4/2009 | Byrne | E02D 17/10 | 405/282 |
| 2010/0264390 | A1 * | 10/2010 | Cerda | E04G 5/142 | 29/428 |
| 2022/0018082 | A1 * | 1/2022 | Molyneux | E02D 17/083 | |

FOREIGN PATENT DOCUMENTS

| | | | | | |
|---|---|---|---|---|---|
| CN | 114541421 | A | * | 5/2022 | |
| FR | 1535655 | A | | 8/1968 | |
| GB | 1212361 | A | * | 11/1970 | |
| GB | 2585695 | A | * | 1/2021 | E02D 17/08 |
| JP | S525912 | A | | 1/1977 | |
| SE | 9403884 | L | | 5/1996 | |

* cited by examiner

TRENCH SHORING APPARATUS

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

This invention relates to a lockable trench shoring apparatus, a lock for a trench shoring apparatus and its method of use. In particular, this invention relates to a lockable trench shoring apparatus that can be quickly and easily deployed in a trench to provide a temporary earth retaining structure which prevents the excavated sides of a trench from collapse and which allows personnel to access and work in the trench in a safe and secure environment.

2. Description of Related Art Including Information Disclosed Under 37 CFR 1.97 and 37 CFR 1.98

The skilled person will appreciate that with most forms of residential, commercial and light industrial property construction, the first stages of the work generally involve ground preparation and levelling of the site, prior to excavation of trenches or ditches that ultimately form the foundation footings of the property. Equally, earth excavations can be needed for the installation of pipelines, structures and water, drainage, sewerage, gas and other sub-surface utilities and assets. Work of this nature is usually carried out using heavy construction equipment, such as excavators or diggers.

Depending upon the soil and environmental conditions, there is often the risk of the vertical or near vertical sides of the excavation collapsing into the trench, which not only requires significant rework, introducing associated delays and costs, but more importantly, this presents a danger to construction workers and other personnel working on, or near, the excavation site.

Often construction personnel, installation or repair workers, need to enter the excavated trench to lay, install, repair, or otherwise access utilities or assets being laid in, or exposed within, in the trench. Current UK and European Standards specify the criteria in which a trench shoring system is required to protect workers in a trench from a cave-in or collapse. There are various proprietary trench boxes available in the art which generally comprise side walls of varying thicknesses and which are held apart by steel or aluminium props, jacks or spreaders. Commercial trench boxes of this type are time consuming to install, and crucially often require the construction or utilities worker to enter the trench to construct the trench box, with the associated risk of death or injury from a cave-in or collapse. In addition to commercial trench boxes, workers sometimes construct ad hoc structures, made up of boarding to contact the excavated side of the trench and utilise what is to hand that can act as a prop or jack. There is also a strong need for a lockable trench shoring apparatus that, when deployed in the excavated trench, can be locked or secured in place and which is able to resist any lateral force from the excavated sides of trenches or ditches and which also allows construction and/or utilities personnel to safely enter the trench to carry out repairs or installation work.

It is an object of the present invention to provide a lockable trench shoring apparatus, a lock for a trench shoring apparatus and its method of use which overcomes or reduces the drawbacks associated with known products of this type, or other ad hoc shoring structures. It is a further object of the present invention to provide a lockable trench shoring apparatus that can be quickly and easily deployed to provide a temporary earth retaining structure which prevents the excavated sides of trenches or ditches from cave-in or collapse. The insertion and deployment of the lockable trench shoring apparatus of the present invention being at all times from above the surface of the trench and requiring no work inside the trench. It is a further object of the present invention to provide a lockable trench shoring apparatus that can be deployed without the use of hand tools and which occurs automatically using a pivoting hinge mechanism as the lockable trench shoring apparatus is lowered into the bottom of the trench, such that the space between the side walls of the trench and the side panels of the apparatus are taken up automatically. It is a further object of the present invention to provide a lockable trench shoring apparatus that can be further secured and locked in place when deployed, such that it can resist any lateral force from the excavated sides of trenches or ditches and which allows construction and/or utilities personnel to safely enter the trench to carry out repairs or installation work. The lock being a simple and effective, and highly visible, safety mechanism. It is a further object of the present invention to provide a lockable trench shoring apparatus that can be quickly unlocked and retrieved from the trench after use, again without the need for a worker to enter, reach or lean into the trench or ditch.

BRIEF SUMMARY OF THE INVENTION

The present invention is described herein and in the claims.

According to the present invention there is provided a trench shoring apparatus, comprising:

first and second side panels connected in a parallel spaced-apart configuration by a connecting bar pivotally connected to one end of one or more pairs of lateral arms, the other opposite end of the one or more pairs of lateral arms being hingedly connected to the side panels, such that translational movement of the connecting bar in a direction parallel to the side panels causes the spaced-apart panels to move between retracted and extended parallel spaced-apart configurations; and locking means for releasably restricting translational movement of the connecting bar.

An advantage of the present invention is that it can be used to quickly and securely provide a lockable temporary earth-retaining structure which prevents the excavated sides of a trench or ditch from cave-in or collapse. The trench shoring apparatus can be very easily and quickly locked in place to resist all lateral force from the sides of the trench or ditch and which allows personnel to access and work in the trench in a shielded and secure environment.

Preferably, the first and second side panels having a castellated cross section and each having an inner and outer surface, and wherein the outer surfaces of the first and second side panels abut with the excavated sides of the trench when in use, and wherein the inner surfaces of the first and second side panels are each connected to a plurality of elongate backplates positioned from the top to the bottom of the side panels.

Further preferably, the elongate backplates are each secured to the inner surfaces of the first and second side panels via a seam of welding.

In use, the retracted configuration may have a lateral dimension which is less than the width of the trench into which the apparatus is inserted when in use and which is less than the width of the extended configuration.

Preferably, the elongate backplates form a fixed part of a hinge connection and having a generally L-shaped cross section.

Further preferably, the pairs of lateral arms form a moving part of the hinge connection, the pairs of lateral arms further comprising right-angled triangular upper and lower hinge plates disposed towards the middle and towards the bottom of the trench shoring apparatus.

In use, the middle and lowermost hinge plates may be identical in size and shape.

Preferably, the middle and lowermost hinge plates each include a proximal aperture which meets with a complementary aperture disposed in a front face of the backplate and secured using a threaded fastener to permit pivotal movement of the upper and lower hinge plates relative to the elongate backplate.

Further preferably, the pivotal movement of the middle and lowermost hinge plates being possible in an upward direction only as a side edge of the upper and lower hinge plates abuts against the side face of the backplate thereby preventing movement in a downward direction.

In use, the middle and lowermost hinge plates may be received in pairs along the front face of the backplate.

Preferably, each connecting bar is disposed between the middle and lowermost hinge plates.

Further preferably, the connecting bars are planar and elongate having apertures towards the middle and lowermost parts thereof which meet with distal apertures disposed on the upper and lower hinge plates for receiving a threaded fastener therethrough.

In use, a projection may extend perpendicularly from the near the upper part of the connecting bar, the projection supporting a first hoisting loop disposed thereon, and wherein the uppermost part of the connecting bar is configured as a support platform for receiving one end of a removable hoisting beam.

Preferably, the hoisting beam is elongate and each end thereof is received upon on the support platform of the connecting bar, the hoisting beam having a second hoisting loop disposed at each end thereof such that the hoisting beam releasably connects to the apparatus by a hook and chain disposed between the first hoisting loop and the second hoisting loop.

Further preferably, the hoisting beam further comprises a downwardly facing deflection shoulder disposed at each end thereof and which assists in locating the hoisting beam on top of the support platform located at the uppermost part of the connecting bar.

In use, the hoisting beam may further comprise a rotatable U-shaped lifting hitch having hoisting or slinging bars located thereon, and wherein the lifting hitch being located towards the centre of the hoisting beam.

Further preferably, the hoisting beam further comprises means for receiving forklift blades or tines being positioned either side off the lifting hitch.

Preferably, the locking means further comprises:

a pair of elongate pivoting arms each having at a pivoting end thereof which is pivotally connected to the hinge plates and connecting bar, and an opposite free end which can move in an arc and comprises a cut-out or notch for receiving a cylindrical abutment disposed in the front face of the backplate and an annular opening disposed at each free end thereof; and an elongate cross piece which comprises a generally flat strip of metal and projecting from one face of the cross piece is a plurality of cylinders, the cylinders being slidably receivable in the annular opening disposed at each free end of the pivoting arms.

Further preferably, when the spaced-apart panels are in an extended parallel spaced-apart configuration, the cross piece can be used to lock the pivoting arms in an extended position with the outermost cylinders of the cross piece being received within the annular openings disposed at the free ends of the pivoting arms.

In use, when the spaced-apart panels are in an retracted parallel spaced-apart configuration, the cross piece can be used to lock the pivoting arms in an retracted position with the innermost cylinders of the cross piece being received within the annular openings disposed at the free ends of the pivoting arms.

Preferably, a retaining or R-clip is securable to retain the cross piece in place through a diametric aperture disposed at the distal end of the cylinders.

Further preferably, a string of U-shaped rungs disposed in the inner surface of the castellated side panels, the rungs being configured to form an internal ladder which provide access to the extended and locked trench shoring apparatus when in use.

Preferably, a series of internal steps being attached to the connecting bar and which provides access to the extended and locked trench shoring apparatus when in use.

In use, a retractable guardrail may be disposed at the inner surface of the side panels and which is erectable to provide edge protection to prevent falls into the extended and locked trench shoring apparatus when in use.

Preferably, the trench shoring apparatus further comprises a deployable shutterboard which, in use, closes-off the open ends of the extended and locked trench shoring apparatus.

Further preferably, the removable shutterboard is receivable inside a frame comprising a first elongate member positioned from the top to the bottom of the inner surface of the first side panel and an opposite second elongate member positioned from the top to the bottom of the inner surface of the second side panel, each of the first and second elongate members defining a generally U-shaped channel into which the shutterboard is slidably received.

In use, a ground mat which abuts against the first and/or second side panels for improved aboveground trafficking and access may be provided.

Preferably, the ground mat comprises a plurality of peripheral securing apertures through which the ground mat can be secured to the first and/or second side panels and/or to the ground.

Further preferably, the ground mat comprises an anti-slip tread pattern formed in a top surface thereof.

Preferably, the metalwork components forming the apparatus are selected from a material from the group consisting, but not limited to, any one of the following: mild, powder-coated or galvanised steel, or aluminium and the like.

In use, the shutterboard, ground mat and/or parts thereof may be manufactured from wood or a composite wood-like material or a suitable plastics or rubberised material selected from the group consisting, but not limited to, any of the following: Polypropylene (PP), Low-Density Polyethylene (LDPE), High-Density Polyethylene (HDPE), Polyethylene Terephthalate (PET), Polyvinyl Chloride (PVC) or Acrylonitrile Butadiene Styrene (ABS), Glass Reinforced Nylon (GRN), resins or blends thereof.

Also according to the present invention there is provided a lock for a trench shoring apparatus as hereinbefore described, the lock comprising:

a pair of elongate pivoting arms each having at a pivoting end thereof which is pivotally connected to the hinge plates and connecting bar, and an opposite free end which can move in an arc and comprises a cut-out or notch for receiving a cylindrical abutment disposed in the front face of the backplate and an annular opening disposed at each free end thereof; and an elongate cross piece which comprises a generally flat strip of metal and projecting from one face of the cross piece is a plurality of cylinders, the cylinders being slidably receivable in the annular opening disposed at each free end of the pivoting arms.

Further according to the present invention there is provided a method of supporting the side walls of an excavated trench using the trench shoring apparatus as hereinbefore described, the method comprising the steps of:

coupling a sling to the removable beam of the trench shoring apparatus;

hoisting the apparatus thereby causing the spaced-apart panels to move to the retracted spaced-apart configuration;

lowering the retracted apparatus into the excavated trench;

pushing the hoisting beam downwards such that the side panels splay apart into the extended spaced-apart configuration to abut against the side walls of the excavated trench;

uncoupling the removable beam from the first hoisting loop disposed on the connecting bar and hoisting it clear of the extended apparatus; and engaging the locking means to restrict translational movement of the connecting bar.

Likewise according to the present invention there is provided a trench shoring apparatus, comprising:

first and second side panels connected in a parallel spaced-apart configuration by a connecting rod pivotally connected to a free end of one or more pairs of telescopically-extendable struts, the other opposite end of the one or more pairs of telescopically-extendable struts being pivotally connected to the side panels via a pivot arm, such that translational movement of the connecting rod in a direction parallel to the side panels causes the spaced-apart panels to move between retracted and extended parallel spaced-apart configurations, and whereby in an extended parallel spaced-apart configuration the opposite end of the one or more pairs of telescopically-extendable struts abuts against the side panels such that the one or more pairs of telescopically-extendable struts are aligned in an opposed lengthwise configuration to resist any lateral forces applied from the sides of the trench and being retracted by translational movement of the connecting rod in a generally upward direction.

Preferably, each one of the pairs of telescopically-extendable struts comprises an outer section which receives a telescopically-extendable inner section therein, the inner section being received within the outer section via an elongate threaded screw arrangement.

Further preferably, the threaded screw arrangement is rotatable via an aperture disposed in an abutment end face of the outer section and which adjusts the telescopic spacing between the inner and outer sections.

In an extended parallel spaced-apart configuration, the abutment end face of the outer section of the one or more pairs of telescopically-extendable struts may abut against a pocket formed in the castellated cross section of the sheet piles comprising the side panels.

Preferably, the threaded screw arrangement having square or buttress threads.

It is believed that a lockable trench shoring apparatus, a lock for a trench shoring apparatus and its method of use in accordance with the present invention at least addresses the problems outlined above.

It will be obvious to those skilled in the art that variations of the present invention are possible and it is intended that the present invention may be used other than as specifically described herein.

BRIEF DESCRIPTION OF THE SEVERAL VIEWS OF THE DRAWINGS

The present invention will now be described by way of example only, and with reference to the accompanying drawings.

FIGS. 11*a*, 11*b*, 11*c* and 11*d* show side plan views of the trench shoring apparatus being hoisted and then deployed in a locked configuration with the struts set to a minimum, midway and maximum spacing therebetween, respectively.

DETAILED DESCRIPTION OF THE INVENTION

The present invention has adopted the approach of utilising a lockable trench shoring apparatus that can be quickly and easily deployed to provide a temporary earth retaining structure which prevents the excavated sides of trenches or ditches from cave-in or collapse. Advantageously, the insertion and deployment of the lockable trench shoring apparatus of the present invention being at all times from above the surface of the trench and requiring no work inside the trench. Further advantageously, the present invention provides a lockable trench shoring apparatus that can be deployed without the use of hand tools and which occurs automatically using a pivoting hinge mechanism as the lockable trench shoring apparatus is lowered into the bottom of the trench, such that the space between the side walls of the trench and the side panels of the apparatus are taken up automatically. Further advantageously, the present invention provides a lockable trench shoring apparatus that can be further secured and locked in place when deployed, such that it can resist any lateral force from the excavated sides of trenches or ditches and which allows construction and/or utilities personnel to safely enter the trench to carry out repairs or installation work. Further advantageously, the lock being a simple and effective, and highly visible, safety mechanism. Further advantageously, the present invention provides a lockable trench shoring apparatus that can be quickly unlocked and retrieved from the trench after use, again without the need for a worker to enter, reach or lean into the trench or ditch.

Figure 1:
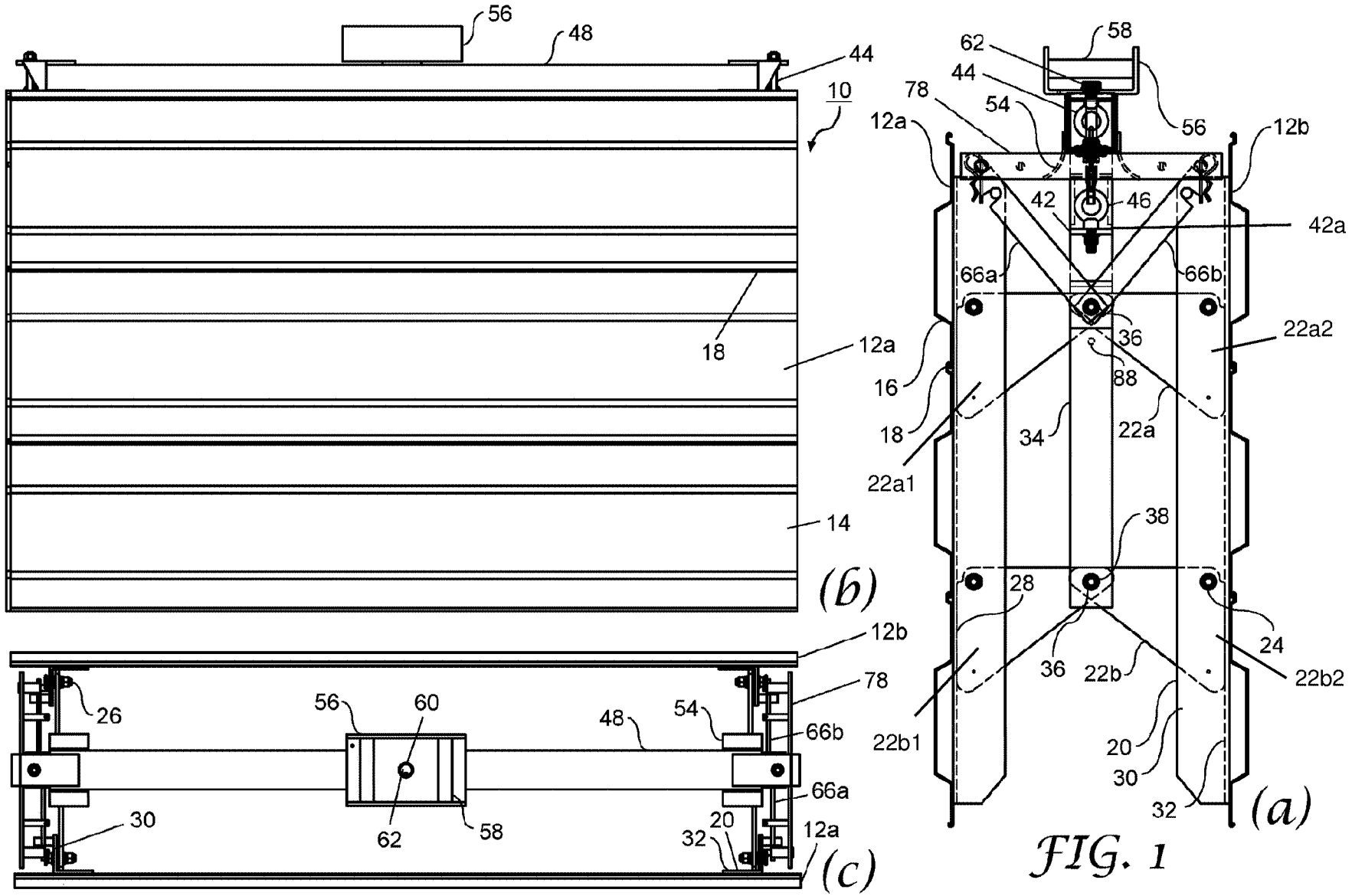
FIGS. 1*a*, 1*b* and 1*c* illustrate front, side and top plan views respectively of a lockable trench shoring apparatus in accordance with the present invention.
Figure 2:
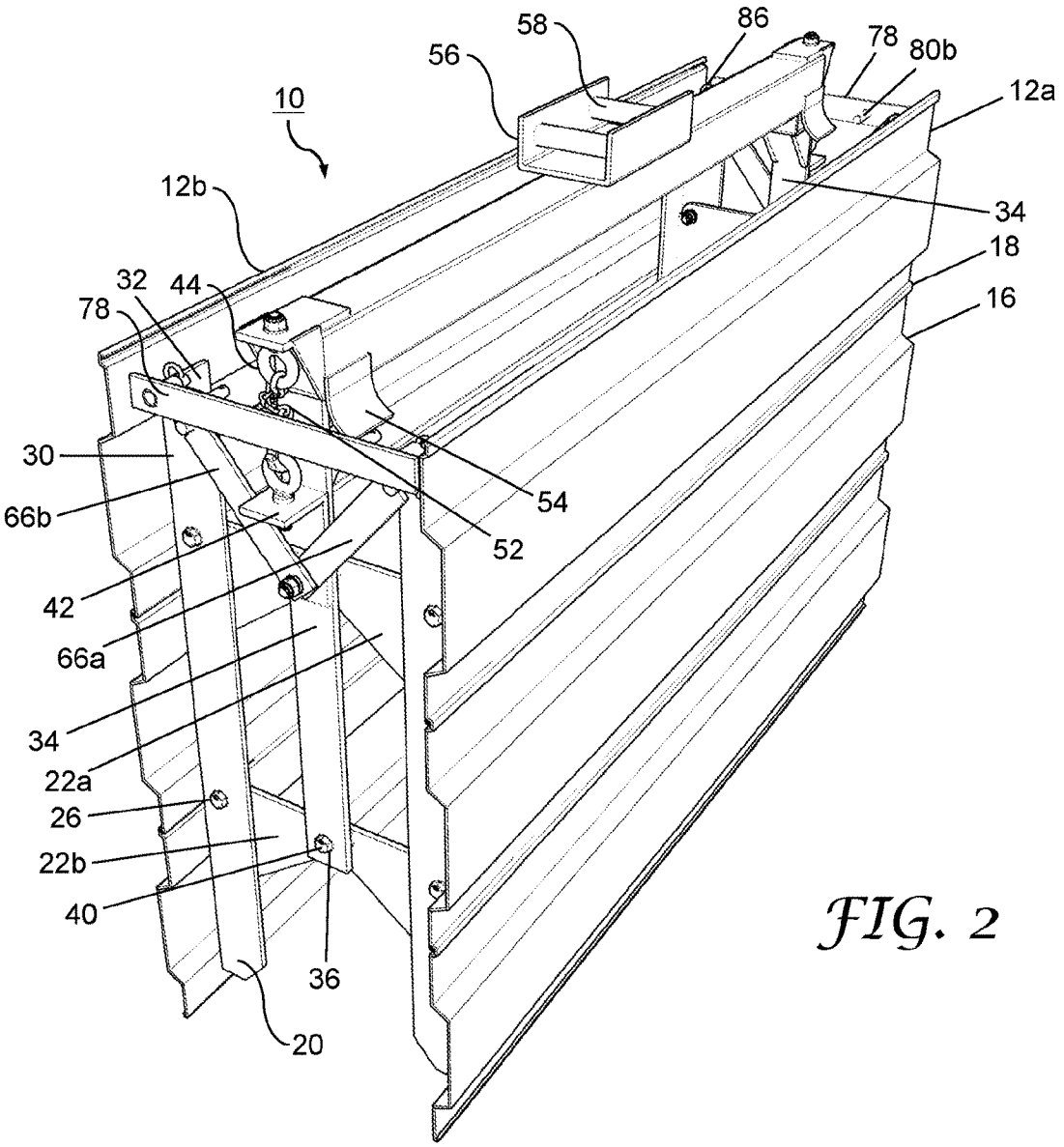
FIG. 2 shows a perspective view from the side and above of the lockable trench shoring apparatus of FIG. 1 being in a deployed and locked configuration.

Referring now to the drawings, a lockable trench shoring apparatus 10 according to the present invention is illustrated in FIGS. 1 and 2. FIGS. 1*a*, 1*b* and 1*c* show front, side and top plan views respectively of the lockable trench shoring apparatus 10, and FIG. 2 shows a perspective view from the side and above of the lockable trench shoring apparatus 10 being in a deployed and locked configuration.

The lockable trench shoring apparatus 10 is formed having first and second panels 12*a*, 12*b* held in a parallel spaced-apart configuration. In a preferred embodiment, the panels 12*a*, 12*b* are formed from sheet piles 14 which include a castellated cross section 16 and generally horizontal seams 18 being arranged to interlock the separate sheets of piling 14 together. In a preferred embodiment, the interconnection between the separate piling sheets 14 is by spot-welds or the like. The skilled person will appreciate that when the apparatus 10 is deployed in a trench (not shown), it is the outer surface of the panels 12*a*, 12*b* that are in contact with the excavated sides of the trench or ditch to prevent a cave-in or collapse. Whilst in a preferred embodiment of the invention, the first and second panels 12*a*, 12*b* are formed from castellated piling sheets 14, the skilled person will appreciate that any number of structurally durable panels, including planar panels, could be utilised. A pair of elongate backplates 20 are positioned from the top to the bottom of each of the side panels 12*a* 12*b* situated towards each end thereof, as best shown in FIG. 2. Each elongate backplate 20 being secured to inner surface of the panels 12*a*, 12*b* through a seam of welding, although any number of mechanical attachments could be utilised.

The first and second side panels 12*a*, 12*b* are connected in a parallel spaced-apart configuration and the spaced-apart panels 12*a*, 12*b* are able to move between extended and retracted spaced-apart parallel configurations when being deployed in, or retrieved from, a trench (not shown). It will be appreciated that within this application, the term "extended configuration" means a deployed or spaced-apart parallel configuration of the side panels 12*a*, 12*b* in which the outer surfaces of the side panels 12*a*, 12*b* abut against the side walls of the excavated trench. The term "retracted configuration" means a reduced spaced-apart lateral configuration or dimension between the side panels 12*a*, 12*b*. The retracted configuration has a spaced-apart dimension which is less than the extended configuration, and critically less than the width of the trench or ditch into which the apparatus 10 is to be deployed. Movement of the side panels 12*a*, 12*b* between retracted and extended spaced-apart configurations is via a pivoting and locking hinge mechanism, as described below.

The backplates 20 form a fixed part of a hinge mechanism and have a generally L-shaped cross section in plan view from above, as best shown in FIG. 1*c*. The backplate 20 having a generally flat front panel or face 30 and a side wall or face 32 which extends perpendicularly from one side of the front face 30. The front 30 and side walls 32 in combination define a structural backplate 20 onto which other moving components of the pivoting and locking hinge mechanism are affixed.

Pivotally connected to the backplate 20 is the moving part of the hinge mechanism and this is provided by hinge plates 22*a*, 22*b* disposed near the middle and bottom respectively of the lockable trench shoring apparatus 10, as shown in FIGS. 1*a* and 2. In particular, an upper hinge plate 22*a* is disposed towards the middle section of the apparatus 10 and a lower hinge plate 22*b* disposed nearer the lower section of the apparatus 10. The upper and lower hinge plates 22*a*, 22*b* being generally planar and identical in size and shape. In use, the upper and lower hinge plates 22*a*, 22*b* are configured as scalene right-angled triangles.

Situated adjacent to the 90 degree angle of the upper and lower hinge plates 22*a*, 22*b* is a proximal aperture 24 which is secured to a complementary aperture 90 disposed in the front face 30 of the backplate 20 using a threaded fastener 26. The skilled person will appreciate that such a configuration permits pivotal movement of the upper and lower hinge plates 22*a*, 22*b* relative to the backplate 20 in an upward direction only, since the side edge 28 of the upper and lower hinge plates 22*a*, 22*b* abuts against the side wall 32 of the L-shaped support 20 preventing movement in a downward direction. To further facilitate pivotal movement of the upper and lower hinge plates 22*a*, 22*b* relative to the backplate 20 a radiused cut-out or indent 68 is additionally situated adjacent to the 90 degree angle of the upper and lower hinge plates 22*a*, 22*b*, as shown in FIG. 3*a*.

The upper and lower hinge plates 22*a*, 22*b* are received in pairs along each front face 30 of the L-shaped backplate 20. Disposed between the two sets of upper and lower hinge plates 22*a*, 22*b* are a series of moveable connecting bars 34, as best shown in FIGS. 2 and 4. The connecting bars 34 are elongate bars having apertures 36 disposed towards the middle and lower section of the bar 34 and which meet with distal apertures 38 situated adjacent to the angle opposite to side edge 28 disposed on the hinge plates 22*a*, 22*b*. The apertures 36, 38 receive a threaded fastener 40 therethrough, as best shown in FIGS. 1 and 3*a*.

The skilled person will appreciate that when deployed, the lockable trench shoring apparatus 10 comprises a box-shaped structure, the side panels 12*a*, 12*b* of which can be used to contact or abut against the excavated sides of trenches or ditches to prevent cave-ins or collapse.

The pivoting hinge mechanism formed by the pivotal connection of the backplate 20, hinge plates 22*a*, 22*b* and connecting bar 34 is such that movement of the connecting bar 34 in a direction parallel to the side panels 12*a*, 12*b* causes the spaced-apart panels 12*a*, 12*b* to move between an extended parallel spaced-apart configuration for deployment in a trench, and a retracted parallel spaced-apart configuration for insertion into the trench.

In use, the lockable trench shoring apparatus 10 is hoisted into the excavated trench or ditch using a mechanical excavator or digger (not shown) and a hoisting beam 48, as will be described below.

Figure 5:
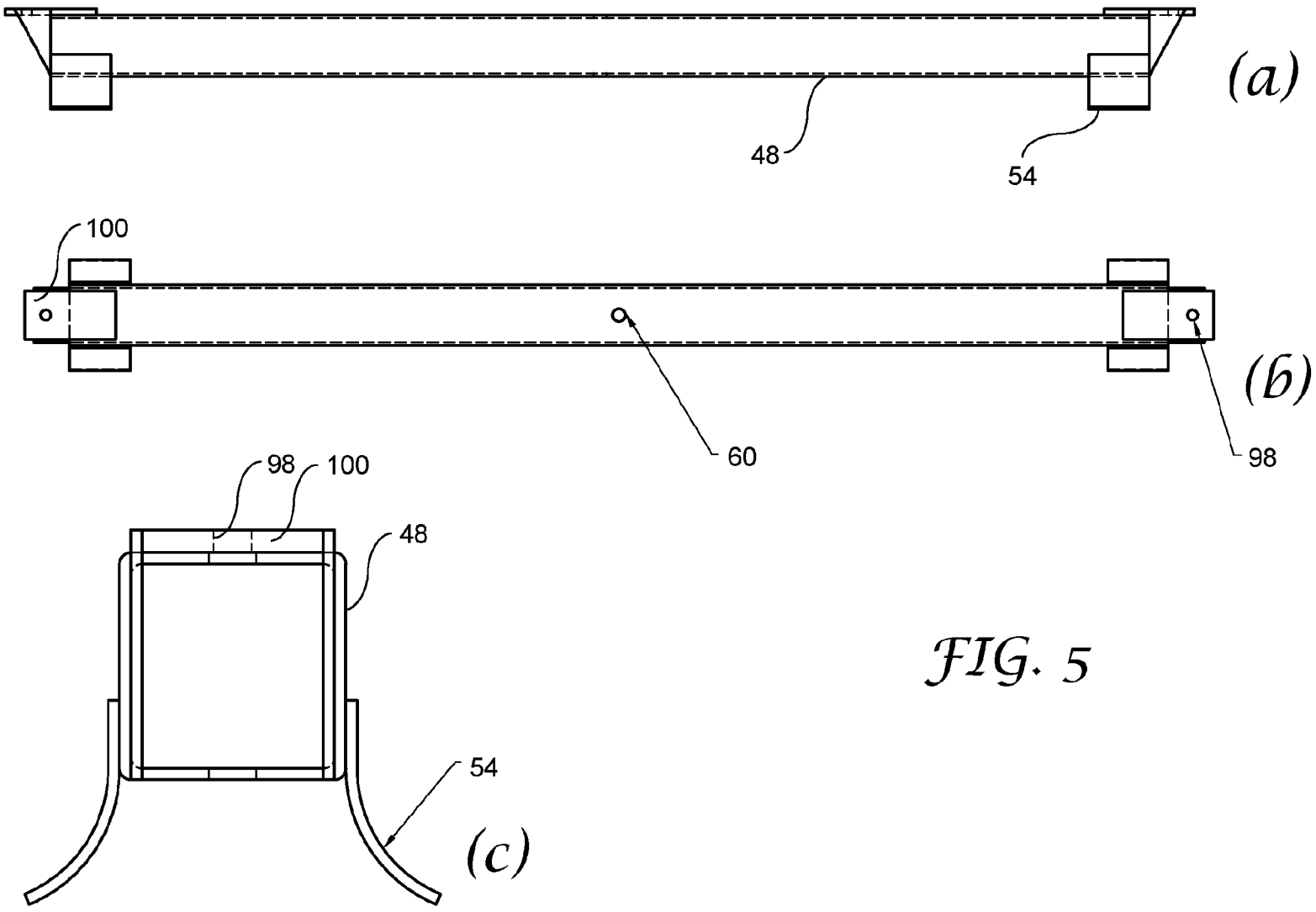
FIGS. 5*a*, 5*b* and 5*c* illustrate side, top and front plan views respectively of the removable lifting beam of the lockable trench shoring apparatus of FIG. 1.

To enable this, a pair of hoisting loops 44 are each disposed on a platform or projection 42 that extends perpendicularly from the near the upper part of the connecting bar 34, as best shown in FIG. 2. In use, each of the hoisting loops 44 is mounted in a aperture 92 and positioned underneath a second hoisting loop 46 which is connected to each end of the hoisting beam 48 though an aperture 98 disposed in a support plate 100, as best shown in FIG. 5. The hoisting beam 48 is elongate and is supported upon on the uppermost part of the connecting bar 34 which is configured as a cradle or support 50 which is formed from a box-section material 94 being supported by buttress 96.

In use, the hoisting beam 48 is positioned on the support 50 of the connecting bar 34. The hoisting beam 48 is itself formed from a length of box-section steel and the hoisting loop 46 formed at each end of the elongate hoisting beam 48 releasably connects to the hoisting loop 44 disposed on the platform 42 of the connecting bar 34 by a hook and chain arrangement 52, as shown in FIG. 2.

At each end of the hoisting beam 48 is a downwardly facing deflection shoulder 54 which assists in locating the hoisting beam 48 on top of the complementary-dimensioned support 50 located at the uppermost part of the connecting bar 34. Positioned towards the centre of the elongate hoisting beam 48 is a U-shaped lifting hitch 56 which has hoisting or slinging bars 58 located therein. The lifting hitch 56 is pivotally connected 60 to the hoisting beam 48 and secured by a threaded fastener 62.

In use, the operator of the excavator connects a length of chain or other flexible sling (not shown) onto one or both of the pair of hoisting bars 58 disposed at the top of the apparatus 10. The skilled person will understand that lifting the hoisting beam 48 causes the connecting bar 34 to be raised upwards through the chain 52 releasably connected between the hoisting loops 44, 46. In doing so, the hinge plates 22, 22*b* are able to rotate upwards such that the spaced-apart side panels 12*a*, 12*b* come together. Equally when the apparatus 10 is deployed in a trench, a downward force (through gravity or a push from an excavator bucket) on the connecting bar 34 serves to push the hinged plates 22*a*, 22*b* downwards, such that the side panels 12*a*, 12*b* are deployed against the sides of the trench. In this configuration, however there is a risk that a lateral force applied to the side panels 12*a*, 12*b* could force the connecting bar 34 upwards. As such, the trench shoring apparatus 10 of the present invention is also provided with a locking mechanism 64, as will be described below.

The locking mechanism 64 can be readily actuated or engaged to restrict any movement of the connecting bar 34 relative to the backplate 20, such that when the apparatus 10 is deployed, the side panels 12*a*, 12*b* of the apparatus 10 cannot be moved despite any lateral force applied thereto.

Figure 3:
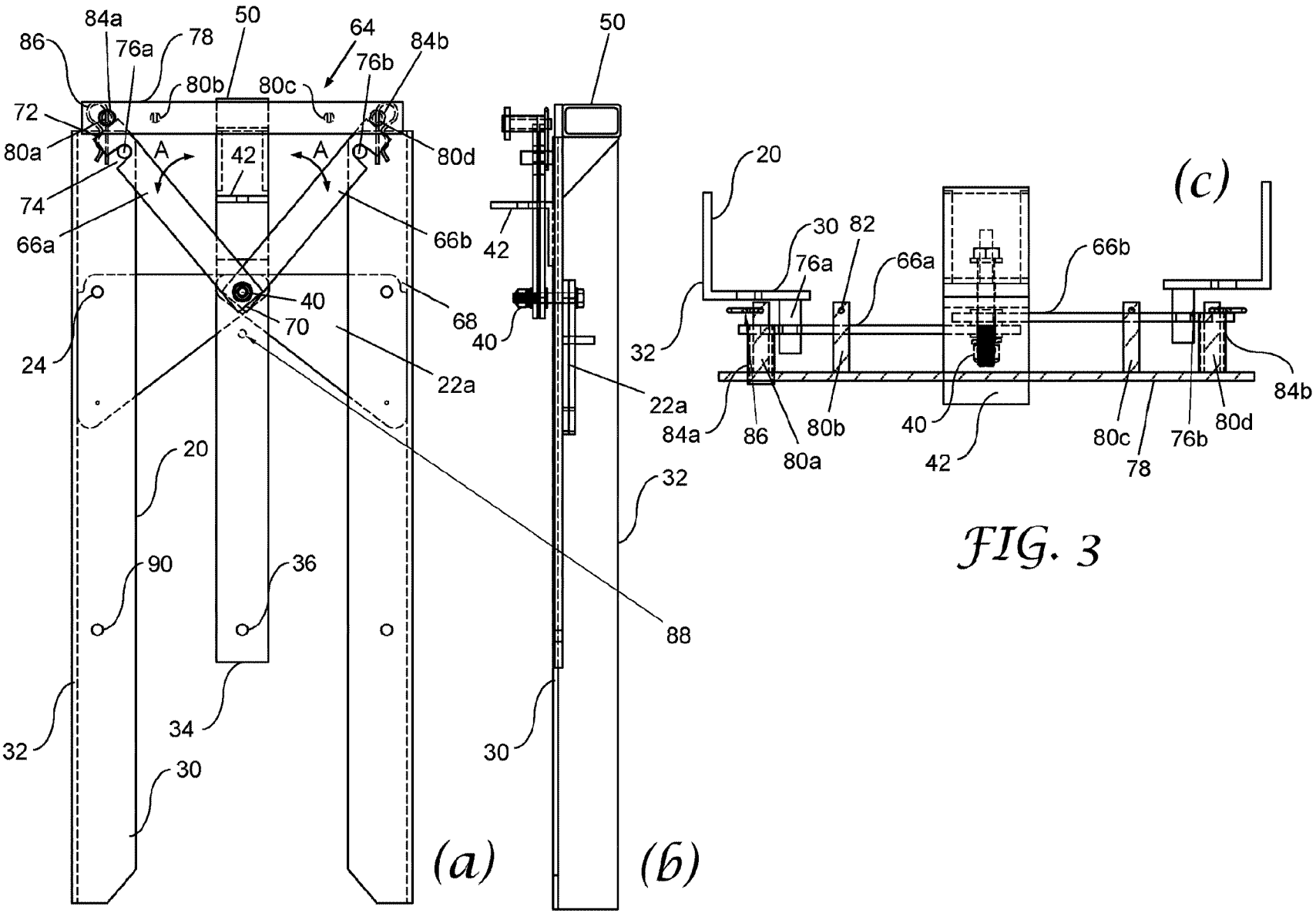
FIGS. 3*a*, 3*b* and 3*c* are front, side and top plan views respectively of the locking mechanism of the lockable trench shoring apparatus of FIG. 1.
Figure 4:
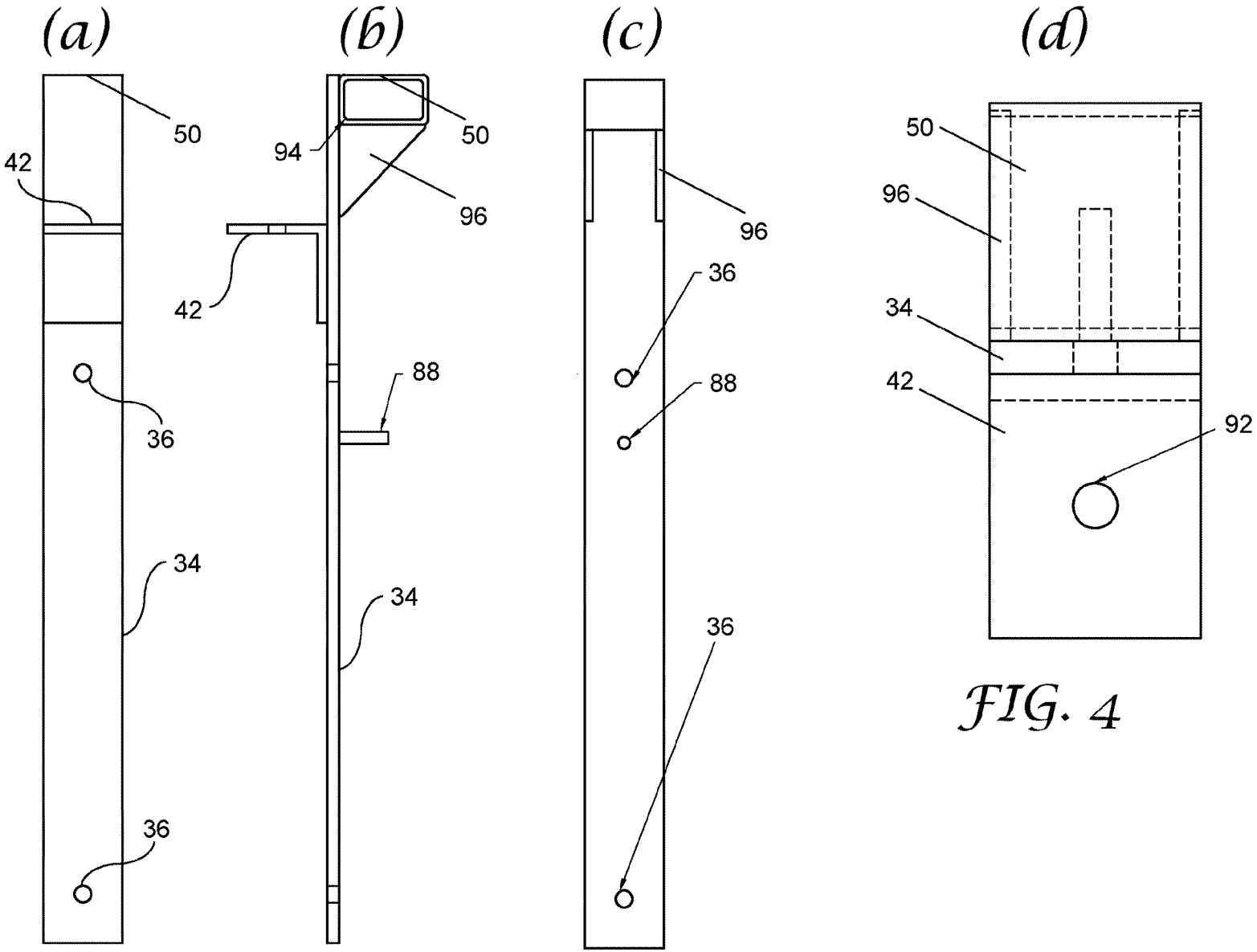
FIGS. 4*a*, 4*b*, 4*b* and 4*d* show front, side, rear and top plan views respectively of the central connecting bar of the lockable trench shoring apparatus of FIG. 1.

As shown in FIG. 3, the triangular locking mechanism 64 comprises three parts, namely a pair of pivoting arms 66*a*, 66*b* which at a pivoting end 70 thereof are connected to the hinge plates 22*a*, 22*b* through apertures 36, 38 which receive threaded fastener 40. The skilled person will understand that pivoting arms 66*a*, 66*b* are able to pivot in the direction of double arrow A shown in FIG. 3*a*.

Opposite to the pivoting end 70 of the pivoting arms 66*a*, 66*b* is a free end 72. Each of the free ends 72 of the pivoting arms 66*a*, 66*b* includes a cut-out or notch 74 into which can receive a respective cylindrical bar 76*a*, 76*b* which is disposed in the front face 30 of the L-shaped backplate 20.

The third part of the locking mechanism 64 comprises an elongate cross piece 78. The elongate cross piece 78 is best shown in FIG. 3*c*, and is clarified by the additional hatching used in FIG. 3*c*. In particular, the elongate cross piece 78 comprises a generally flat strip of metal material and projecting from one face of the cross piece 78 are four cylinders or bars 80*a*-80*d* that each have a small diametric aperture 82 disposed at the distal end thereof.

In a deployed configuration, the cross piece 78 can be used to lock the pivoting arms 66*a*, 66*b* in position as the outer cylinders 80*a*, 80*d* can be received within annular openings 84*a*, 84*b* disposed at the free ends 72 of the pivoting arms 66*a*, 66*b*, respectively. In addition, a separate retaining or R-clip 86 can secure the cross piece 78 in place through the apertures 82 in the cylinders 80*a*, 80*d*. Such a configuration is shown in FIGS. 3*a*, 3*b* and 3*c*.

The locking mechanism 64 can also be placed into an unlocked position simply by removing the R-clips 86 from the outer cylinders 80*a*, 80*d* and pulling the cross piece 78 clear. The pivoting arms 66*a*, 66*b* can then be pivoted upwards, clearing the cylindrical projections 76*a*, 76*b* from the notches 74 at the free ends 72 thereof. The cross piece 78 can then secure the free ends 72 of the pivoting arms 66*a*, 66*b* in an unlocked position by placing the inner cylinders 80*b*, 80*c* into the annular openings 84*a*, 84*b* disposed at the free ends 72 of the pivoting arms 66*a*, 66*b*.

FIG. 3*a* also shows that a structural welded bar disposed 88 under the hinge plates 22*a*, 22*b* provides an abutment which prevents the hinge plates 22*a*, 22*b* from fully closing when the apparatus 10 is hoisted.

The use of the present invention will now be described.

Typically, an open trench or ditch is excavated using an excavator, as mentioned above. Depending primarily upon the soil substrate and the weather conditions this open trench is at a risk of collapse or cave-in. To shore the trench, the trench shoring apparatus 10 of the present invention can be utilised, which enables a much quicker and secure shoring to be carried out by construction or utilities workers without the need to enter, lean or reach into the excavated trench or ditch.

To shore the excavated trench or ditch, the operator of the excavator connects a length of chain or other flexible sling (not shown) onto the pair of hoisting loops 58 disposed at the rotatable hoisting platform 56 at the top of the hoisting beam 48 of the apparatus 10. The length of chain is then connected or wrapped around the bucket or dipper arm such that the trench shoring apparatus 10 can be hoisted clear of the ground. In doing so, the translational movement of the connecting bar 34 in a direction parallel to the side panels 12*a*, 12*b* causes the spaced-apart panels 12*a*, 12*b* to move to a retracted spaced-apart configuration whereby the apparatus 10 can be inserted in a trench. The retraction being limited by the projection 88 on the connecting bar 34 which limits the rotation of the hinge support plates 22*a*, 22*b*.

In this way, the hoisted apparatus 10 can then be lowered into the trench or ditch and the bucket of the excavator used to push down on the top of the beam 48 to then splay the spaced-apart side panels 12*a*, 12*b* apart into the extended configuration such that they abut against the side walls of the excavated trench or ditch. In this way, the deployed apparatus 10 acts to shore the trench or ditch without needing to enter the trench or ditch or lean into it, which is a much safer and quicker means of providing temporary support. In this configuration, the beam 48 at the top of the trench shoring apparatus 10 can then be removed by unhooking the chain 52 between the hoisting loops 44, 46 and lifting it clear. The side panels 12*a*, 12*b* of the trench shoring apparatus 10 can then be locked in place using the locking mechanism 64 described below.

To engage the locking mechanism 64, the free ends 72 of the pivoting arms 66*a*, 66*b* are moved downwards such that the cut-out or notch 74 receives the respective cylindrical bar 76*a*, 76*b* which is disposed in the front face 30 of the L-shaped backplate 20. The cross piece 78 is then slidably inserted in a position whereby the outer cylinders 80*a*, 80*d* are received within annular openings 84*a*, 84*b* disposed at the free ends 72 of the pivoting arms 66*a*, 66*b*, respectively. An R-clip 86 is then placed through the apertures 82 in the cylinders 80*a*, 80*d*.

When it is needed to remove the lockable apparatus 10, the above method is followed in reverse and the locking mechanism 64 is firstly disengaged by removing the R-clips 86 from the outer cylinders 80*a*, 80*d* and pulling the cross piece 78 clear. The pivoting arms 66*a*, 66*b* can then be pivoted upwards, clearing the cylindrical projections 76*a*, 76*b* from the notches 74 at the free ends 72 thereof. The cross piece 78 can then secure the free ends 72 of the pivoting arms 66*a*, 66*b* in an unlocked position by placing the inner cylinders 80*b*, 80*c* into the annular openings 84*a*, 84*b* disposed at the free ends 72 of the pivoting arms 66*a*, 66*b* and securing this in place using R-clips 86 placed through the apertures 82 in the inner cylinders 80*b*, 80*c*. The apparatus 10 can then be lifted out cleanly without causing any damage to the walls of the excavated trench.

Figure 6:
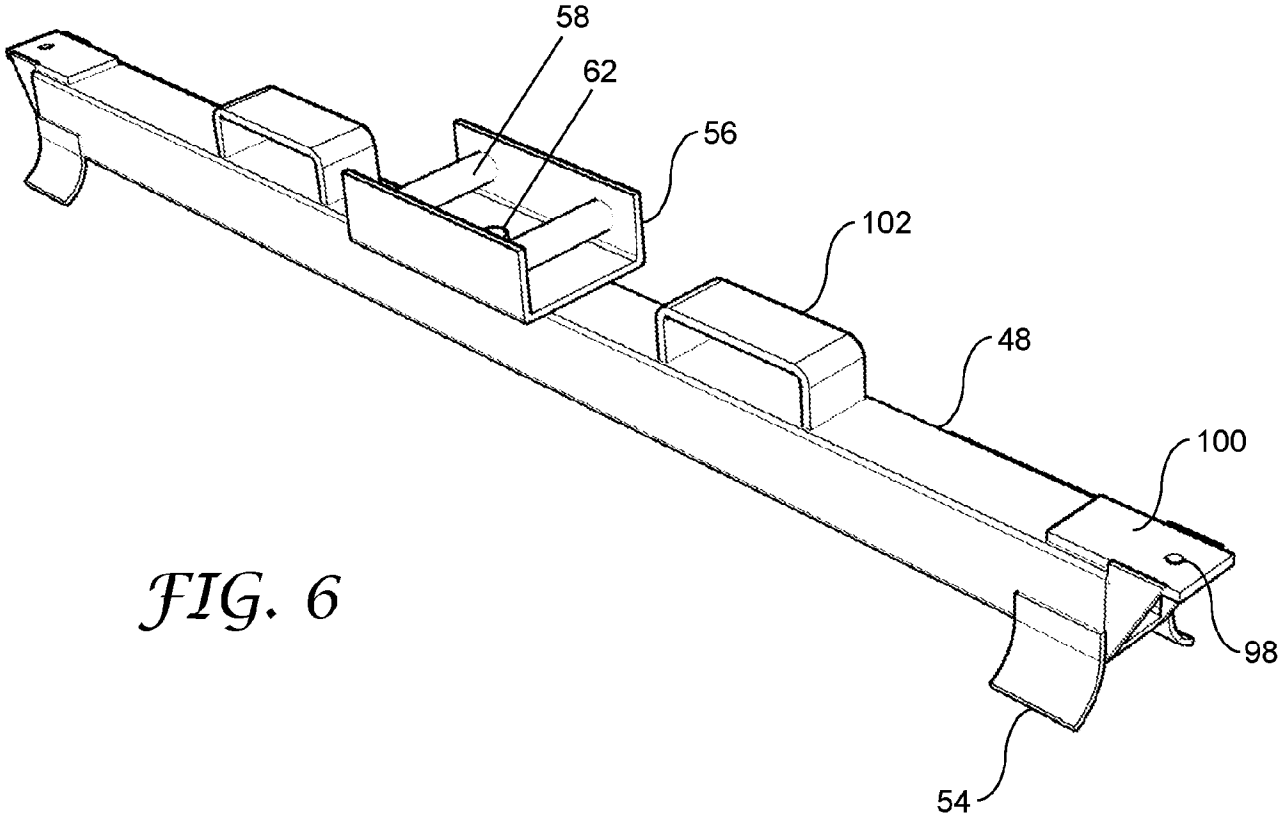
FIG. 6 is a perspective view from the side and above of a removable lifting beam that includes means for receiving forklift blades or tines.

FIG. 6 shows a removable lifting beam 48 that includes means for receiving forklift blades or tines. In FIG. 6, a pair of fork pockets 102 are positioned either side off the lifting hitch 56. The pockets 102 being dimensioned to receive forklift blades or tines (not shown in FIG. 6) from forklift trucks or other wheeled or tracked powered industrial equipment, such as, backhoe-loaders and the like. The advantage of providing such fork pockets 102 on the lifting beam 48 are that the trench shoring apparatus 10 can be transported and utilised at the worksite more easily, rather than having to rely solely on excavators and diggers.

Figure 7:
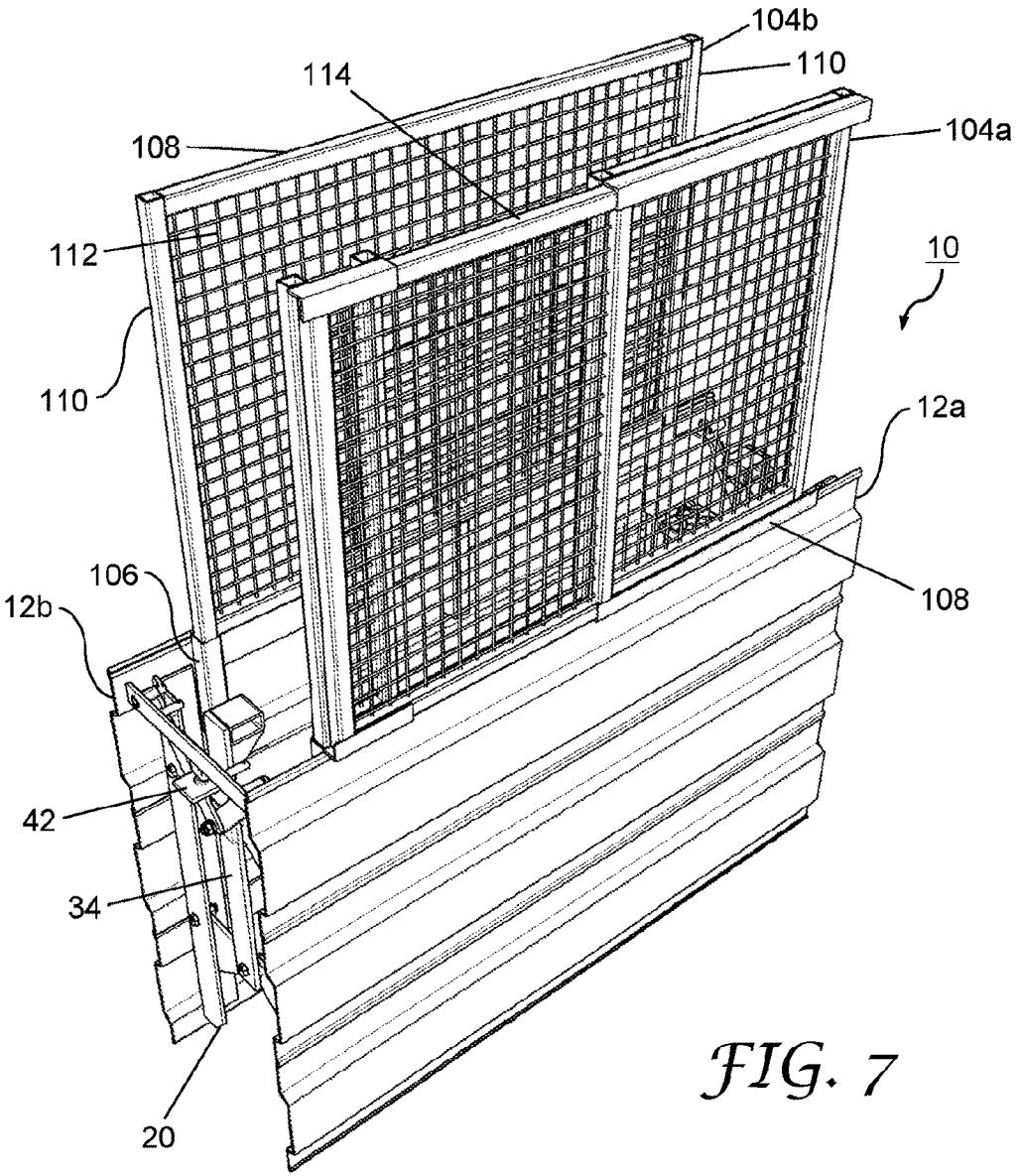
FIG. 7 shows a perspective view from the side and above of the lockable trench shoring apparatus of FIG. 1 being in a deployed and locked configuration and being provided with a mountable guardrail which provides edge protection.

FIG. 7 shows how the trench shoring apparatus 10 of the present invention can be utilised with mountable guardrails 104*a*, 104*b* which provide edge protection. The skilled person will appreciate that when the trench shoring apparatus 10 has been lowered into the bottom of the excavated trench or ditch, as described above, and the beam 48 removed by unhooking the chain 52 between the hoisting loops 44, 46 and lifting it clear, this open-topped trench shoring apparatus 10 would represent a fall hazard. To combat this, a pair of mountable guardrails 104*a*, 104*b* can be slidably received inside female connectors 106 which are positioned towards the top of each of the side panels 12*a*, 12*b*, as shown in FIG. 7.

The skilled person will appreciate that each of the mountable guardrails 104*a*, 104*b* is formed having generally horizontal members 108 at the top and bottom thereof, which meet with generally vertical members 110. The plurality of members 108, 110 are arranged so as to define a space into which a wire mesh panel 112 can be affixed. Although not shown in FIG. 7, the skilled person will appreciate that one end of each generally vertical member 110 is elongate and protrudes downwards beyond the wire mesh panel 112 and the lowermost horizontal member 108, and can be slidably received in the box-section female connector 106 and retained in place. The female connector 106 being dimensioned such that there is a clearance fit between it and the generally vertical member 110 which enables the two parts to be slidably assembled and held in place.

One or more of the mountable guardrails 104*a*, 104*b* (in FIG. 7, this is illustrated as mountable guardrail 104*a*), can include an access gate 114, which can be slidably opened to enable worker access into the locked trench shoring apparatus 10. The access gate 114 being slidably received inside the upper and lower horizontal members 108, as is known to someone skilled in the art.

Figure 8:
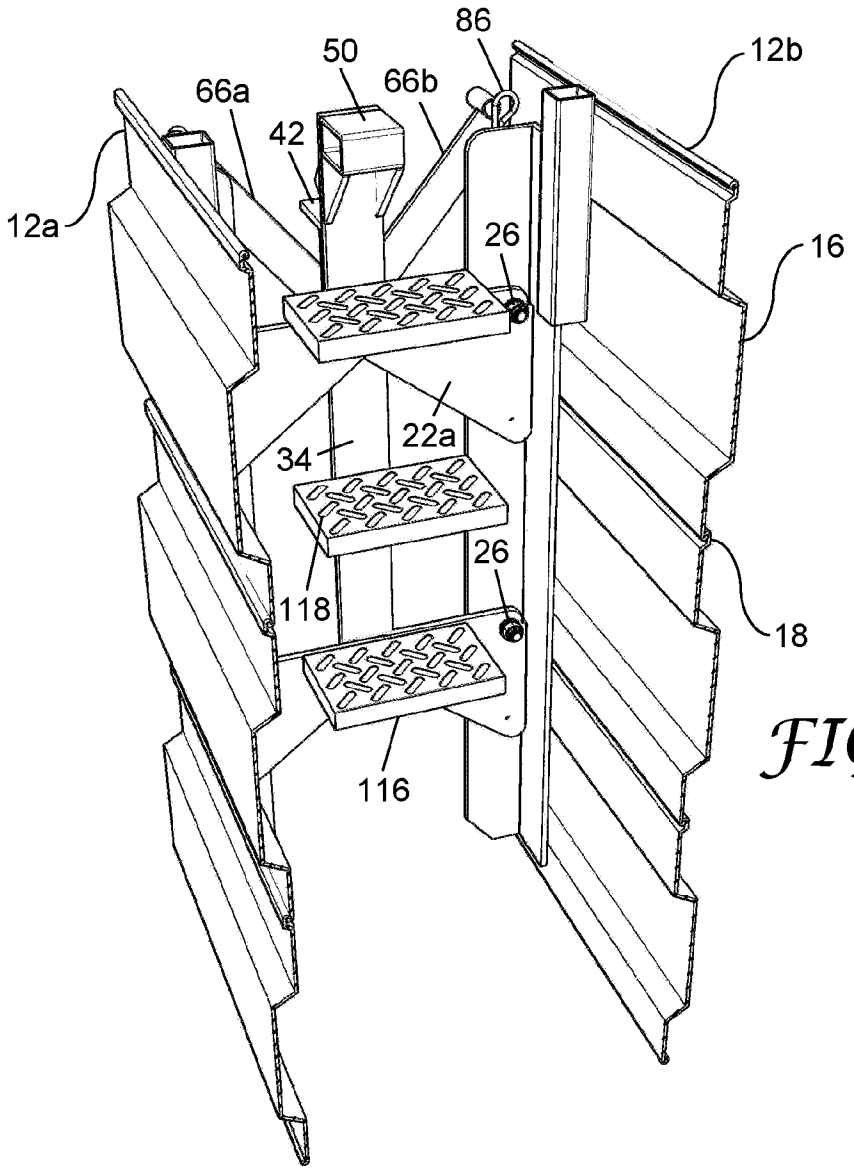
FIG. 8 illustrates a cutaway perspective view from the side and above of the interior of the lockable trench shoring apparatus of FIG. 1 being in a deployed and locked configuration and being provided with a series of internal steps to allow a worker to safely descend into, and ascend from, the shored trench.

FIG. 8 shows a cutaway perspective view from the side and above of the interior of the lockable trench shoring apparatus of FIG. 1 being in a deployed and locked configuration and being provided with a series of internal steps 116 to allow a worker to safely descend into, and ascend from, the shored trench. In use, the internal steps 116 are affixed to the connecting bar 34 through a seam of welding, although any number of mechanical fixtures and fasteners could be utilised. The uppermost face of each internal step 116 may also include cut-outs 118 with raised edges or be configured as anti-slip tread plate or the like.

As described previously, the retracted spaced-apart configuration of the apparatus 10 is limited by engagement of projection 88 against the connecting bar 34 which limits the rotation of the hinge support plates 22*a*, 22*b*. In such a retracted spaced-apart configuration of the hoisted apparatus 10 there is enough lateral space for the set of internal steps 116. The skilled person will appreciate that the internal steps 116 allow safe worker access into the bottom of the trench shoring apparatus 10 when in a deployed and locked configuration, as shown in FIG. 8.

Figure 9:
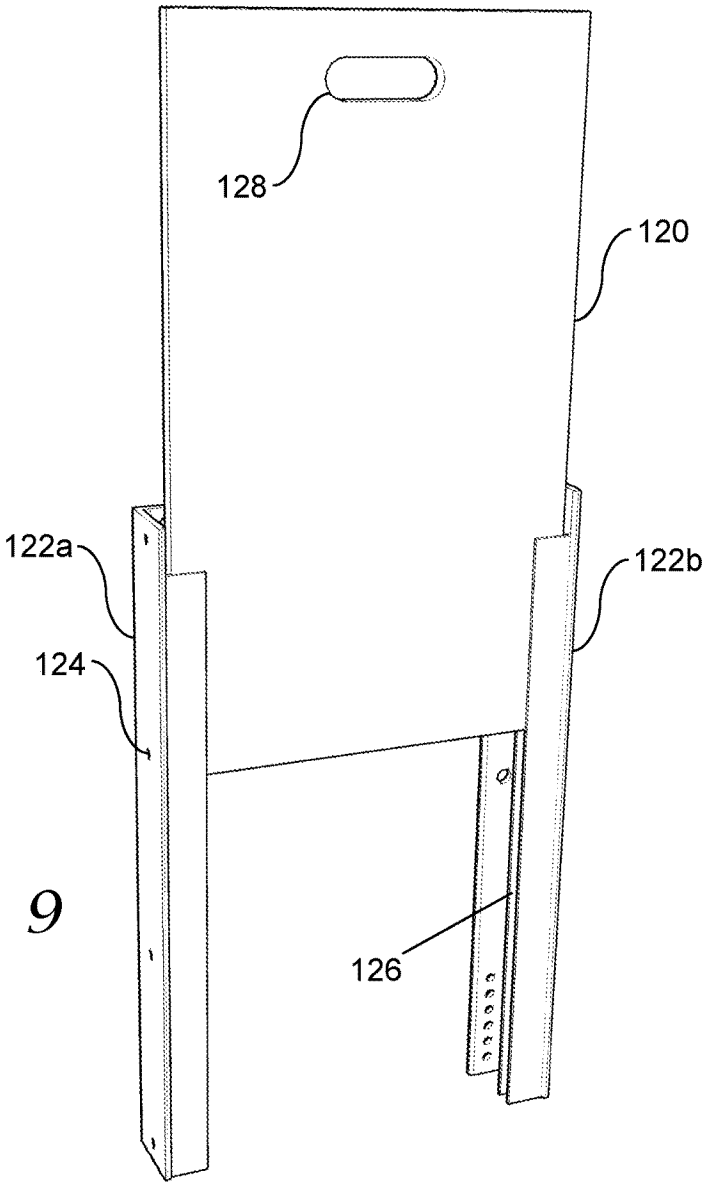
FIG. 9 is a perspective view from the side and above of a deployable shutterboard which can be used to close-off the open ends of the deployed and locked trench shoring apparatus when in use.

FIG. 9 is a perspective view from the side and above of a deployable shutterboard 120 which can be used to close-off the open ends of the deployed and locked trench shoring apparatus 10 when in use. The first and second panels 12*a*, 12*b* of the deployed and locked apparatus 10 prevent the abutting excavated sides of the trench or ditch from cave-in or collapse, however, if there is no neighbouring trench shoring apparatus 10 in the excavated trench there is the risk that a nearby cave-in or collapse could still enter the open ends of the deployed and locked trench shoring apparatus 10, and which presents a danger to workers or other personnel deployed in the apparatus 10.

In order to mitigate the risk of such a nearby cave-in or collapse if the trench shoring apparatus 10 is used in isolation, or is at the end of a string of such deployed trench shoring apparatuses 10 in an excavated trench, then the shutterboard 120 can be used at each open end of the apparatus 10. The removable shutterboard 120 is receivable inside a frame formed as a first elongate member 122*a* positioned from the top to the bottom of the inner surface of panel 12*a* and an opposite second elongate member 122*b* positioned from the top to the bottom of the inner surface of panel 12*b*. Each of the frame parts 122*a*, 122*b* being fastened to the inner surfaces of side panels 12*a*, 12*b* through fasteners (not shown) through apertures 124 or via a seam of welding.

Each of the frame members 122*a*, 122*b* defining a generally vertical U-shaped channel 126 into which the shutterboard 120 can be slidably inserted and retracted. This is facilitated by an elongate aperture 128 which is acts as a grab handle towards the top of the shutterboard 120, as shown in FIG. 9. When not required, the shutterboard 120 can be entirely removed from the apparatus 10.

Figure 10:
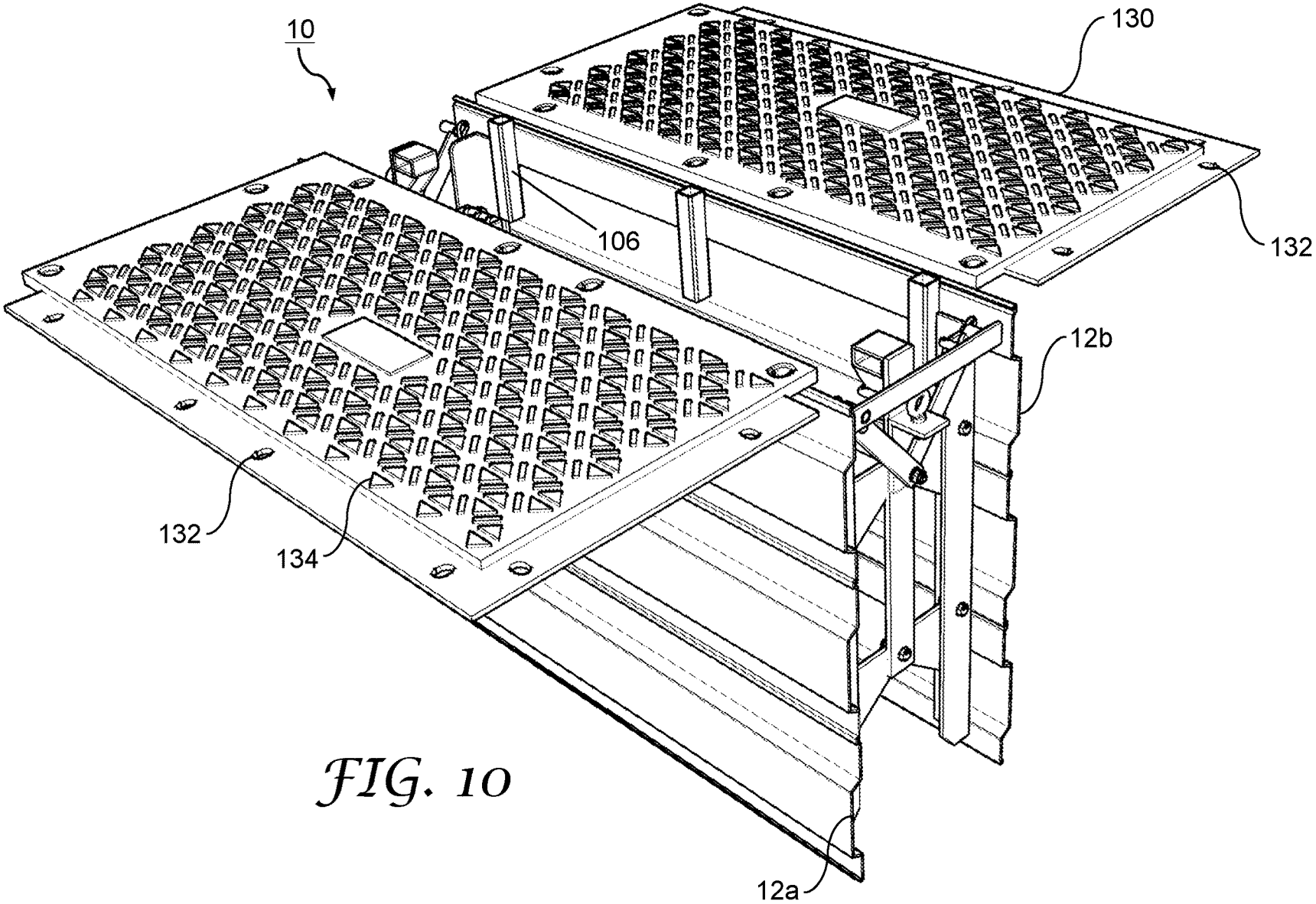
FIG. 10 shows a perspective view from the side and above of the lockable trench shoring apparatus of FIG. 1 being in a deployed and locked configuration and being provided with a ground mats which abut against the side panels for improved aboveground trafficking and access.

FIG. 10 shows a perspective view from the side and above of the lockable trench shoring apparatus 10 being in a deployed and locked configuration and provided with a ground mats 130 which abut against the side panels 12*a*, 12*b* for improved aboveground trafficking and access when in use. The ground mats 130 include a plurality of peripheral securing apertures 132 that can be secured to the top of each of the side panels 12*a* 12*b* using a variety of fixing means, or directly to the ground. In one embodiment, the ground mats 130 can be attached to the side panels 12*a* 12*b* through the female connector 106 or the like. This is in no way intended to be limiting as any number of mechanical fixtures and fasteners could be utilised. To mitigate slipping hazards, an anti-slip tread pattern 134 is formed on the top surface of the ground mats 130. When deployed with ground mats 130, vehicular access and trafficking to and from the apparatus 10 is improved, especially in very wet and muddy ground, and/or the ground mats 130 can prevent the ground from churning up and becoming muddy.

In use, the shutterboard 120, ground mats 130 and/or parts thereof may be manufactured from wood or a composite wood-like material or a suitable plastics or rubberised material selected from the group consisting, but not limited to, any of the following: Polypropylene (PP), Low-Density Polyethylene (LDPE), High-Density Polyethylene (HDPE), Polyethylene Terephthalate (PET), Polyvinyl Chloride (PVC) or Acrylonitrile Butadiene Styrene (ABS), Glass Reinforced Nylon (GRN), resins or blends thereof.

Figure 11:
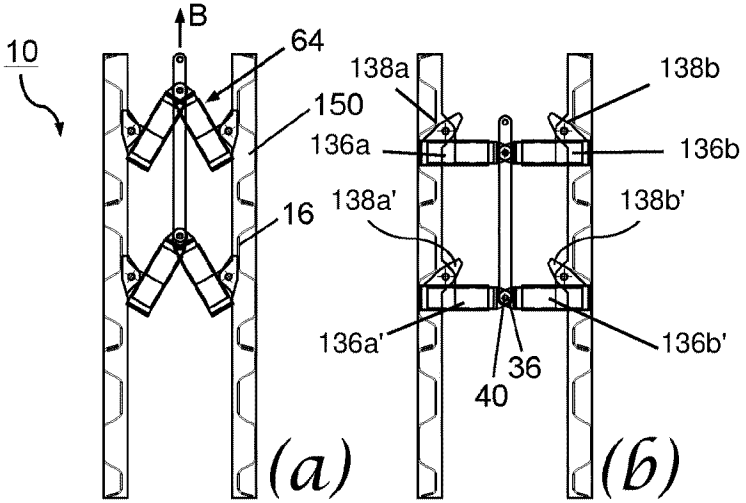
FIG. 11 illustrates an adjustable and lockable trench shoring apparatus in accordance with a second embodiment of the invention and being provided with adjustable struts positioned between the side panels.
Figure 12:
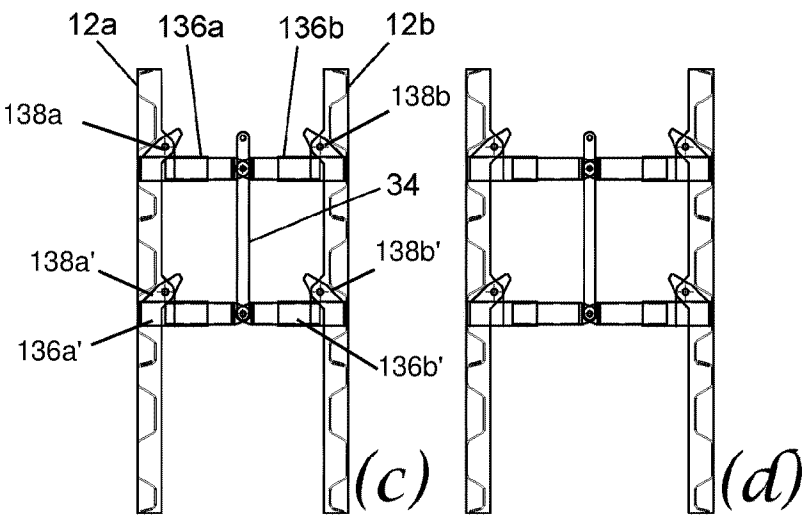
FIGS. 12*a*, 12*b* and 12*c* are cross sectional side plan views of the adjustable strut of FIG. 11 being set to a minimum, midway and maximum spacing, respectively.
Figure 12:
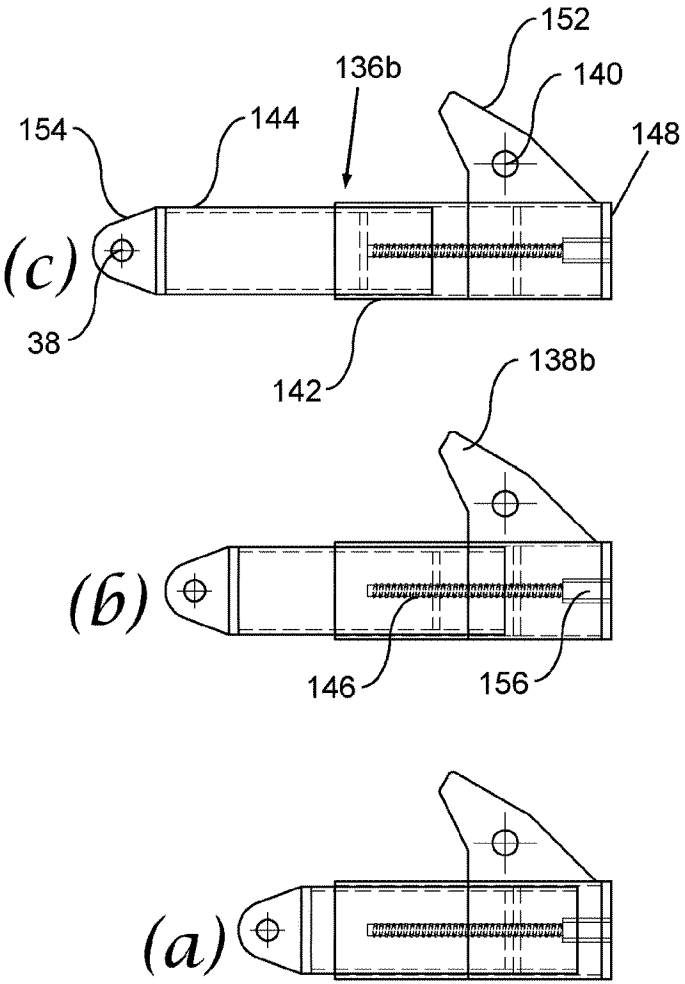

FIGS. 11 and 12 illustrate a second embodiment of the trench shoring apparatus 10. The construction of the second embodiment is very similar to that of the first embodiment and corresponding features have been given the same reference numerals. The second embodiment differs from the first embodiment in that instead of the locking mechanism 64 comprises three parts being readily engageable to restrict any translational movement of the connecting bar 34 relative to the backplate 20, the locking mechanism 64 is instead formed from pairs of extendable struts 136*a*, 136*b* such that when the apparatus 10 is deployed, the side panels 12*a*, 12*b* of the apparatus 10 cannot be moved despite any lateral force applied thereto, as described in further detail below.

In shoring apparatus 10 illustrated in FIGS. 11 and 12, the hinge plates 22*a*, 22*b* have been replaced by extendable struts 136*a*, 136*b*. Very much like that described above in relation to FIGS. 1 and 3*a*, upper and lower extendable struts 136*a*, 136*b* are received in pairs from near the top to towards the middle of the side panels 12*a*, 12*b*.

Disposed between the pairs of upper and lower extendable struts 136*a*, 136*b* is the connecting bar 34 which is positioned at each end of the apparatus 10, and being capable of translational movement in a direction parallel to the side panels 12*a*, 12*b*. Like the first embodiment, the connecting bars 34 are elongate bars having apertures 36 disposed towards the middle and lower section of the bar 34 and which meet with apertures 38 which are on the free ends 154 of the extendable struts 136*a*, 136*b*. The apertures 36, 38 receive a threaded fastener 40 therethrough.

The apertures 38 on the free ends 154 of the extendable struts 136*a*, 136*b* are situated opposite to a fixed pivot point 140 which allows first and second pivot plates 138*a*, 138*b* to be pivotally connected to the inner surface of the side panels 12*a*, 12*b*.

Each one of the pairs of extendable struts 136*a*, 136*b* (and as perhaps best shown in FIGS. 12*a*, 12*b* and 12*c* which show extendable strut 136*b*) is formed having an outer section 142 which receives a telescopically-extendable inner section 144 therein. As best shown in any of FIGS. 12*a*, 12*b* and 12*c*, the inner section 144 is received within the outer section 142 via a threaded screw jack mechanism 146. The screw jack 146 can be rotated via an aperture 156 disposed in an abutment end face 148 of the outer section 142 and through which the telescopic spacing between the outer 142 and inner sections 144 can varied from a minimum (FIG. 12*a*) to a maximum (FIG. 12*c*), and to some midway spacing therebetween (FIG. 12*b*).

Again, as best shown in FIGS. 12*a*, 12*b* and 12*c*, each pivot plate 138*a*, 138*b* is fixed to the outer section 142 such that the abutment end face 148 of the outer section 142 can pivot around pivot 140 and when the trench shoring apparatus 10 is deployed in the trench, the end face 148 is received within a pocket 150 formed in the castellated cross section 16 of the sheet piles 14 forming the side panels 12*a*, 12*b*. This being best shown in any of FIGS. 11*b*, 11*c* and 11*d*. In such a configuration, the extendable struts 136*a*, 136*b* are in a generally horizontal opposed configuration and cannot be moved despite any lateral force applied to the side panels 12*a*, 12*b*, and therefore act as a locking mechanism.

Each pivot plate 138*a*, 138*b* has a abutment face 152 which limits rotation thereof when being hoisted, as shown in FIG. 11*a*. The abutment face 152 abuts against the castellated piling sheet 16 when the trench shoring apparatus 10 is being hoisted by translational movement of the connecting bar 34 (shown in the direction of arrow B in FIG. 11*a*). When the trench shoring apparatus 10 is installed and locked in position (FIG. 11*b*, 11*c* or 11*d*), the abutment end face 148 of the extendable struts 136*a*, 136*b* contacts the side panels 12*a*, 12*b*.

The embodiment shown in FIGS. 11*a*, 11*b*, 11*c* and 11*d* show side plan views of the trench shoring apparatus 10 being hoisted and then deployed in a locked configuration with the struts 136*a*, 136*b* set to a minimum, midway and maximum spacing therebetween, respectively. FIGS. 12*a*, 12*b* and 12*c* are side plan views of the adjustable strut 136*b* being set to a minimum, midway and maximum spacing, respectively.

The skilled person will appreciate that the advantage of the second embodiment of the trench shoring apparatus 10 is that the lateral dimension of the apparatus 10 can be altered to suit the different trench widths.

The advantage of the lockable trench shoring apparatus 10 of the present invention it is it can be simply hoisted into the excavated trench and quickly locked in place, and thus resisting all lateral force from the sides of the trench or ditch with the deployment and subsequent retrieval of the trench shoring apparatus being at all times from above the surface of the trench, and requiring no work whatsoever inside the trench. Having a removable beam 48 means that only one beam 48 is needed for installing a string of trench shoring apparatuses 10 in an excavated trench. When the beam 48 is removed, construction and/or utilities personnel can easily and safely enter the apparatus 10 to carry out repairs or installation work in the trench.

The metalwork components forming the apparatus 10 can be mild, powder-coated or galvanised steel, or aluminium and the like. The locking mechanism 64 and the hoisting beam 48 can additionally be brightly coloured to remind the operator or worker that the locking mechanism 64 should be to be engaged prior to entering the apparatus 10.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in the terms of a means for performing the disclosed function, or a method or process for attaining the disclosed result, as appropriate, separately, or in any combination of such features, can be utilised for realising the invention in diverse forms thereof.

The invention is not intended to be limited to the details of the embodiments described herein, which are described by way of example only. It will be understood that features described in relation to any particular embodiment can be featured in combination with other embodiments.

It is contemplated by the inventor that various substitutions, alterations, and modifications may be made to the invention without departing from the spirit and scope of the invention as defined by the claims. Examples of these include the following:

It is envisaged that a string of U-shaped rungs or steps 116 forming an internal ladder can be disposed in the inner surface of the piling sheets 14, and which provide ease of access to the deployed and locked trench shoring apparatus 10 when in use, as shown in further detail in FIG. 8. The skilled person will also understand that an external ladder can also be used with the trench shoring apparatus 10 to enable trench access by workers or other personnel.

The inner surface of the side panels 12*a*, 12*b* of the apparatus 10 can also support a retractable guardrail which can be quickly and safely erected. Such a guardrail, when erected, provides guardrail edge protection to prevent falls into the deployed apparatus 10, as shown in further detail in FIG. 7.

The skilled person will finally appreciate that the dimensions of the apparatus 10 can be varied depending upon the groundworks, construction or repair work for which the apparatus 10 is utilised.

The external dimensions of the trench shoring apparatus 10 can be adjusted and the present invention utilised in any number of different sizes and applications. It is envisaged that the present invention can be used for major groundworks for large commercial and industrial properties, residential and light industrial property construction, and to installation and remedial works of underground pipes, cables, ducting and utilities in pavements and highways. This list is by way of example only and is in no way intended to be exhaustive.

I claim:

1. A trench shoring apparatus, comprising:

first and second side panels having a retracted parallel spaced-apart configuration and an extended parallel spaced-apart configuration;

a first pair of lateral arms, one first lateral arm of said first pair of lateral arms having one first lateral arm end hingedly connected to said first side panel, and another first lateral arm of said first pair of lateral arms having another first lateral arm end hingedly connected to said second side panel;

a connecting bar having a fixed length between said first and second side panels and being pivotally connected to an opposite first lateral arm end of said one first lateral arm and another opposite first lateral arm end of said another first lateral arm, so as to move said first side panel and said second side panel between said retracted parallel spaced-apart configuration and said extended parallel spaced-apart configuration according to translational movement of said fixed length of said connecting bar along a direction parallel to said first side panel and said second side panel and along a longitudinal axis of said connecting bar; and locking means for releasably restricting the translational movement of said fixed length of said connecting bar, the locking means being connected to both the first and second side panels and said connecting bar, wherein each side panel of the first and second side panels has a castellated cross section, wherein each side panel of the first and second side panel has an inner surface and an outer surface opposite said inner surface so as to abut said outer surface with excavated sides of the trench when in use, and wherein an elongate backplate is connected to a respective inner surface of each side panel of the first and second side panels, said elongate backplate being positioned from a top of each side panel of the first and second side panels to a bottom of each side panel of the first and second side panels.

2. The trench shoring apparatus as claimed in claim 1, wherein a lateral dimension of said retracted parallel spaced-apart configuration is less than a lateral dimension of said extended parallel spaced-apart configuration so as to be insertable in a trench in said retracted parallel spaced-apart configuration.

3. The trench shoring apparatus as claimed in claim 1, wherein said elongate backplate has an L-shaped cross section, wherein said one first lateral arm end of said one first lateral arm hingedly connected to a corresponding elongate backplate of said first side panel, and wherein said one first lateral arm is comprised of a right-angled triangular hinge plate having a right angle side edge of the hinge plate abutted to said elongate backplate so as to point the hinge plate toward a middle between the first and second side panels and downward toward said bottom of a corresponding first side panel of said first and second side panels, the hinge plate having only upward pivotal movement relative to said elongate backplate.

4. The trench shoring apparatus as claimed in claim 1, further comprising:

a second pair of lateral arms below said first pair of lateral arms, one second lateral arm of said second pair of lateral arms having one second lateral arm end hingedly connected to said first side panel, and another second lateral arm of said second pair of lateral arms having another second lateral arm end hingedly connected to said second side panel, wherein said connecting bar is pivotally connected to an opposite second lateral arm end of said one second lateral arm and another opposite second lateral arm end of said another second lateral arm, wherein said one second lateral arm end of said second pair of lateral arms is hingedly connected to said first side panel at a proximal aperture and a complementary aperture disposed in a front face of a respective elongated backplate of a corresponding first side panel of the first and second side panel being secured with a threaded fastener.

5. The trench shoring apparatus as claimed in claim 4, wherein said one second lateral arm is comprised of another hinge plate having another right angle side edge of said another hinge plate abutted to a respective elongate backplate of said corresponding first side panel of the first and second side panels so as to point said another hinge plate toward a middle between the first and second side panels and downward toward said bottom of a corresponding first side panel of said first and second side panels, said another the hinge plate having only upward pivotal movement relative to said elongate backplate.

6. The trench shoring apparatus as claimed in claim 1, wherein said connecting bar is planar and elongated, wherein said one first lateral arm of said first pair of lateral arms is hingedly connected to said connecting bar at a first bar aperture of said connecting bar and a distal aperture disposed in said one first lateral arm being secured with a threaded fastener, and wherein said connecting bar is comprised of a projection extending perpendicularly from an upper part of connecting bar so as to form a support platform at an uppermost part of said connecting bar, the apparatus further comprising:

a first hoisting loop disposed on said projection; and a removable hoisting beam having one end received on said support platform.

7. The trench shoring apparatus as claimed in claim 6, wherein the hoisting beam is elongated, and wherein the hoisting beam is comprised of a second hoisting loop so as to releasably a hook and chain between said first hoisting loop and said second hoisting loop.

8. The trench shoring apparatus as claimed in claim 7, wherein the hoisting beam further comprises a rotatable U-shaped lifting hitch having hoisting bars located thereon, wherein the lifting hitch is located towards a center of the hoisting beam, and wherein the hoisting beam further comprises means for receiving forklift blades being positioned either side off the lifting hitch.

9. The trench shoring apparatus as claimed in claim 1, wherein the locking means further comprises:

a pair of elongate pivoting arms, each elongate pivoting arm having a pivoting end pivotally connected to said first pair of lateral arms and said connecting bar, and an opposite free end opposite said pivoting end so as to be moveable in an arc, wherein said opposite free end is comprised of:

a notch so as to receive a cylindrical abutment of a corresponding elongate backplate; and an annular opening; and an elongate cross piece being comprised of a flat strip of metal and a plurality of cylinders projecting from one face of the cross piece, each cylinder of said plurality of cylinders being slidably receivable in a corresponding annular opening, wherein an outermost cylinder of said plurality of cylinders is received within a corresponding annular opening with the first and second side panels in said extended parallel spaced-apart configuration, and wherein an innermost cylinder of said plurality of cylinders is received within a corresponding annular opening with the first and second side panels in said retracted parallel spaced-apart configuration.

10. The trench shoring apparatus as claimed in claim 9, further comprising: a retaining clip removably secured to a corresponding cylinder of said plurality of cylinders and a respective annular opening through a diametric aperture at a distal end of the corresponding cylinder of the plurality of cylinders.

11. The trench shoring apparatus as claimed in claim 1, further comprising: a string of U-shaped rungs between the first and second side panels so as to form an internal ladder.

12. The trench shoring apparatus as claimed in claim 11, wherein the rungs are attached to said connecting bar.

13. The trench shoring apparatus as claimed in claim 1, further comprising: a retractable guardrail between the first and second side panels and extending above the first and second side panels so as to prevent falls between the first and second side panels.

14. The trench shoring apparatus as claimed in claim 1, further comprising: a deployable shutterboard between the first and second side panels so as to close-off access between the first and second side panels.

15. The trench shoring apparatus as claimed in claim 1, further comprising: a ground mat abutted against at least one side panel of the first and second side panels, wherein said ground mat is comprised of a plurality of peripheral securing apertures so as to secure position of said ground mat, and wherein said ground mat is further comprised of an anti-slip tread pattern formed in a top surface of said ground mat.

16. A method of supporting the side walls of an excavated trench, the method comprising the steps of:

coupling a sling to a removable beam of the trench shoring apparatus, according to claim 1;

hoisting the apparatus so as to move to the first and second side panels into said retracted parallel spaced-apart configuration;

lowering the apparatus with the first and second side panels in said retracted parallel spaced-apart configuration into the excavated trench;

pushing a hoisting beam downwards so as to splay apart the first and second side panels into said extended parallel spaced-apart configuration, the first and second side panels abutting against side walls of the excavated trench;

uncoupling the removable beam from a first hoisting loop disposed on said connecting bar and hoisting the removable beam clear of the apparatus with the first and second side panels in said extended parallel spaced-apart configuration; and engaging the locking means to restrict translational movement of said connecting bar.

17. A lock for a trench shoring apparatus, the lock comprising:

a pair of elongate pivoting arms, each elongate pivoting arm having a pivoting end so as to pivotally connect to a first pair of lateral arms and a connecting bar of a trench shoring apparatus, and an opposite free end opposite said pivoting end so as to be moveable in an arc, wherein said opposite free end is comprised of:

a notch so as to receive a cylindrical abutment of a corresponding elongate backplate of the trench shoring apparatus; and an annular opening; and an elongate cross piece being comprised of a flat strip of metal and a plurality of cylinders projecting from one face of the cross piece, each cylinder of said plurality of cylinders being slidably receivable in a corresponding annular opening, wherein an outermost cylinder of said plurality of cylinders is received within a corresponding annular opening with first and second side panels of the trench shoring apparatus in extended parallel spaced-apart configuration, and wherein an innermost cylinder of said plurality of cylinders is received within a corresponding annular opening with the first and second side panels in said retracted parallel spaced-apart configuration.

18. A trench shoring apparatus, comprising:

first and second side panels having a retracted parallel spaced-apart configuration and an extended parallel spaced-apart configuration;

a first pair of lateral arms, one first lateral arm of said first pair of lateral arms having one first lateral arm end hingedly connected to said first side panel by a first pivot plate, and another first lateral arm of said first pair of lateral arms having another first lateral arm end hingedly connected to said second side panel by another first pivot plate; and a connecting rod having a fixed length between said first and second side panels and being pivotally connected to an opposite first lateral arm end of said one first lateral arm and another opposite first lateral arm end of said another first lateral arm, so as to move said first side panel and said second side panel between said retracted parallel spaced-apart configuration and said extended parallel spaced-apart configuration according to translational movement of said fixed length of said connecting rod along a direction parallel to said first side panel and said second side panel and along a longitudinal axis of said connecting bar, wherein said first pair of lateral arms is comprised of a first pair of telescopically-extendable struts, said opposite first lateral arm end of said one first lateral arm being a free strut end of one first telescopically-extendable strut, said one first lateral arm end being an opposite strut end of said one first telescopically-extendable strut, said another opposite first lateral arm end of said another first lateral arm being another free strut end of another first telescopically-extendable strut, said another first lateral arm end being another opposite strut end of said another first telescopically-extendable strut;

wherein a respective opposite strut end abuts against a corresponding side panel of the first and second side panels according to a corresponding pivot plate in said extended parallel spaced-apart configuration so as to align a respective telescopically-extendable strut of said respective opposite strut end in an opposed lengthwise configuration so as to resist any lateral forces applied from sides of the trench until upward translational movement of said connecting rod.

19. The trench shoring apparatus as claimed in claim 18, wherein said one first telescopically-extendable strut of said first pair of telescopically-extendable struts comprises an outer section and a telescopically-extendable inner section received in said outer section by an elongate threaded screw engagement.

20. The trench shoring apparatus as claimed in claim 19, wherein an abutment end face of said outer section abuts a corresponding side panel of the first and second side panels, said corresponding side panel having a castellated cross section so as to form a pocket, said abutment end face abutting said pocket.

* * * * *